US006347421B1

(12) United States Patent
D'Emilio

(10) Patent No.: US 6,347,421 B1
(45) Date of Patent: Feb. 19, 2002

(54) PORTABLE HEAD PILLOW

(76) Inventor: Carl M. D'Emilio, 115 Shawnee Path, Millington, NJ (US) 07946

( * ) Notice: Subject to any disclaimer, the term of this patent is extended or adjusted under 35 U.S.C. 154(b) by 0 days.

(21) Appl. No.: 09/739,201

(22) Filed: Dec. 18, 2000

(51) Int. Cl.[7] ..... A47C 20/00
(52) U.S. Cl. ..... 5/636; 5/640; 5/637; 297/391
(58) Field of Search ..... 5/636, 637, 645, 5/640; 297/391, 393, 395, 397

(56) References Cited

U.S. PATENT DOCUMENTS

| | | | | | |
|---|---|---|---|---|---|
| 1,386,652 | A | * | 8/1921 | Patton | 5/640 |
| 2,013,481 | A | * | 9/1935 | Stonehill | 5/640 |
| 2,105,319 | A | | 1/1938 | Hedden et al. | |
| 2,765,480 | A | | 10/1956 | Mueller | |
| 2,952,856 | A | | 9/1960 | Ruff | |
| 3,299,451 | A | | 1/1967 | Trogdon | |
| 3,604,026 | A | * | 9/1971 | Scheips | 5/640 |
| 3,667,074 | A | * | 6/1972 | Emery | 257/10 |
| 4,031,578 | A | * | 6/1977 | Sweeney et al. | 5/636 |
| 4,506,396 | A | * | 3/1985 | Ritchie, Jr. et al. | 5/631 |
| D291,396 | S | * | 8/1987 | Smith | D6/601 |
| 4,710,991 | A | * | 12/1987 | Wilmore et al. | 5/637 |
| 4,776,049 | A | | 10/1988 | Perron | |
| D298,715 | S | * | 11/1988 | Swim | D6/601 |
| 5,165,130 | A | * | 11/1992 | Wendling | 5/655 |
| 5,205,611 | A | * | 4/1993 | Stephens | 297/391 |

FOREIGN PATENT DOCUMENTS

| | | |
|---|---|---|
| NO | 57906 | 4/1937 |

* cited by examiner

*Primary Examiner*—Lynne Browne
*Assistant Examiner*—James M. Hewitt
(74) *Attorney, Agent, or Firm*—Carella Byrne Bain Gilfillan Cecchi et al; William Squire

(57) ABSTRACT

A water proof neoprene impregnated sheet material fabric support is formed into an hour-glass shape with two mirror image sections and is surrounded by a zipper which closes the support to form an inner pocket that is water impervious. Two right circular cylindrical cushions form pillow portions made of an inner core of foam rubber encased by an outer woven cotton layer that is mounted to the sections within the periphery thereof. The cushions compress when the pocket is closed forming a watertight pillow that is portable and easily opened for use. A carrying strap is attached to the support for carrying the zipped pillow.

11 Claims, 3 Drawing Sheets

FIG. 1
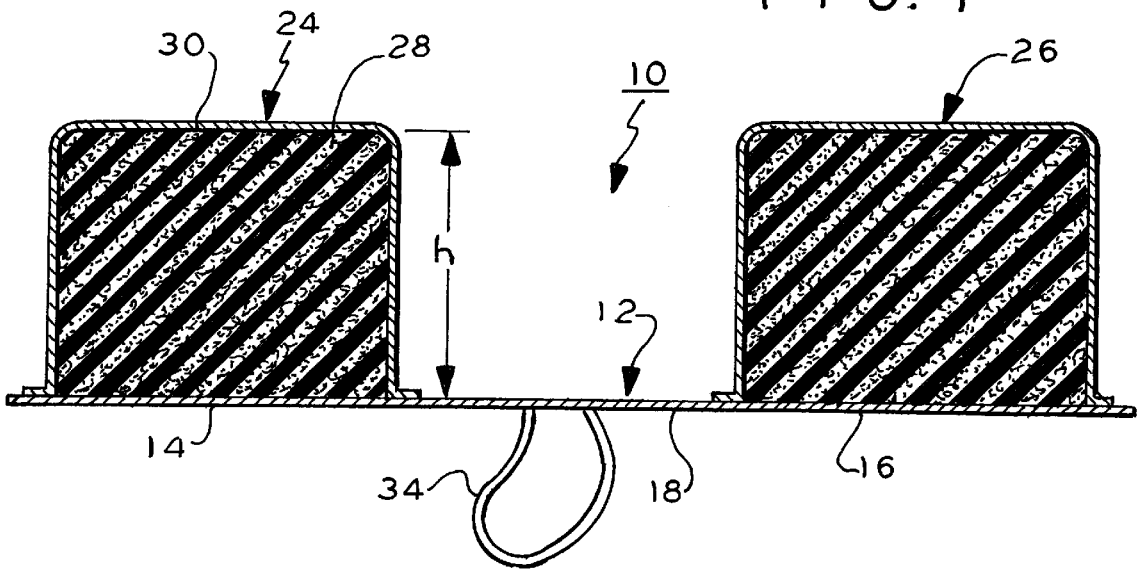
FIG. 2
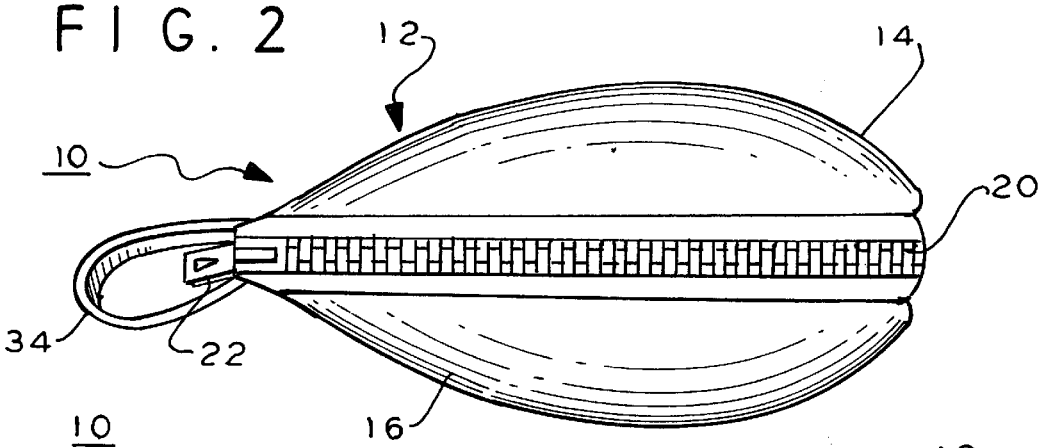
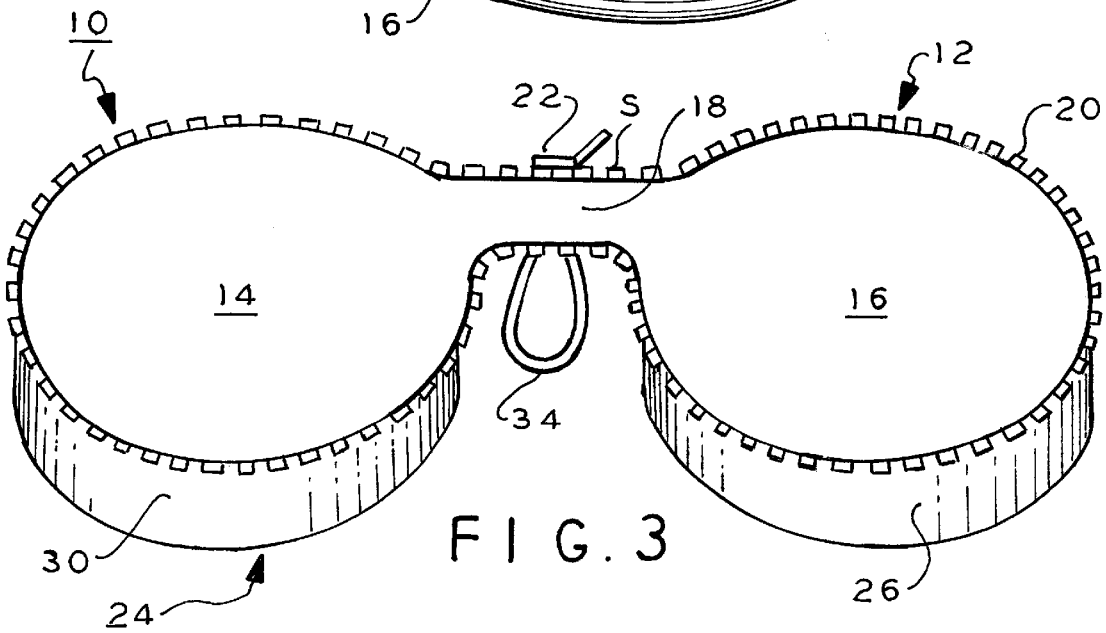
FIG. 3

PORTABLE HEAD PILLOW

This invention relates to portable encased pillows having open and closed states for carrying about in public and for selective use in the open state.

U.S. Pat. No. 2,952,856 discloses an adjustable pillow which includes pad portions interconnected offset from each other. The pad portions are cushioned and arranged to form a continuous pillow or spaced pillows. The pad portions are covered with a fabric and provided with an opening for receiving a bladder that is inflatable. Eyelets and lace are used to enclose the filling material.

U.S. Pat. No. 2,765,480 discloses an orthopedic pillow comprising two stuffed sections separated by a web of flexible material. The web may be of single or multiple thicknesses. The stuffing may be hair, foam rubber, feathers kapoc or the like. The outer fabric cover may be ticking, plastic, or ornamental fabrics such as upholster material. Snaps are used to attach the sections to each other in different orientations. The pillow may be draped over the back of a chair with one section serving to support the back of a person. In another orientation, one section is used as a seat and the other as a backrest. The pillow sections maybe snapped together to form dual layers of sections or a triangular configuration. A strap is connected to the web connecting the sections.

U.S. Pat. No. 3,299,451 discloses a convertible pillow comprising a rectangular pillow section surrounded by a zipper. The pillow when open has the configuration of a regular generally flat bed pillow. When the zipper is zipped together the pillow is formed into a circular cylindrical pillow.

U.S. Pat. No. 3,604,026 discloses a travel pillow comprising a foldable and spreadable pillow wherein duplicate padlike half-sections when folded and fastened together provide a pillow which is comparable in size and shape with individual backrests of automobile seats. The half-sections have limited median portions of side-by-side edge portions stitched and hinged together. Outer marginal edges are provided with connectable snap fasteners, which hold the half sections, folded. Median portions of one half-section also have snap fasteners, which permit the half-section to be manually folded and doubled upon itself and crammed and lodged in a limited holding space. A strap handle is also provided.

U.S. Pat. No. 4,776,049 discloses a head support for a seated person comprising a pair of elongated, stuffed fabric cushions to be seated on a person's shoulders on either side of the neck. A strap is attached to each cushion so extend between behind the neck when the cushions are in position. A second strap is secured to one of the cushions with securing means attached to the other cushion to releasable attach the second strap thereto in front of the person's neck. The straps hold the cushions in place while a person is seated. The pillows are shaped like animals to appeal to children.

U.S. Pat. No. 2,105,319 discloses a bag enclosed with a zipper which may form a brief case, a travel case, a knapsack, a package carrier, pillow structure and so on.

Norsk patent no. 57906 discloses an hourglass shaped filament structure comprising two bulbuls ends interconnected by a thinner strap structure.

The present inventor recognizes that none of the above mentioned patent structures address the need for a head pillow support that will keep the persons head substantially upright while seated and is constructed to be relatively robust and durable for long term use in a portable closed state.

A portable pillow according to the present invention comprises a sheet material support having first and second spaced bulbous sections spaced by a relatively narrower interconnection strap and having a peripheral edge. A zipper is attached to the edge having open and closed states for forming the sections and a portions of the strap into overlying juxtaposed layers in the closed state, the juxtaposed sections and portions in the closed state forming an internal pocket, the sections and strap being substantially coplanar in the open state. A cylindrical cushion of soft, compressible material is attached to each section of the support to form a pair of spaced head cushions for supporting the head of a person therebetween and arranged to be located in the pocket in the closed state of the zipper.

In one aspect, the support is water impervious material. Preferably the cushion is circular cylindrical. In a further aspect, the cushion is foam rubber and the support is neoprene. In a further aspect, the support is rubberized fabric.

In a further aspect, the cushion comprises an outer fabric and a filler material, the outer fabric comprising cotton, the filler material comprising foam rubber. In a still further aspect, the cushion is attached to the support within the peripheral edge by one of stitches and bonding. In a further aspect, a carrying strap is attached to the interconnection strap. Preferably the sheet material and zipper are arranged so that the pocket is water impervious. In a further aspect, the support is sheet thermoplastic material.

IN THE DRAWING

FIG. 1 is a side sectional elevation view of a pillow according to the present invention in the open state;

FIG. 2 is a side elevation view of the pillow of the present invention in the closed state;

FIG. 3 is an isometric view of the bottom of the pillow showing the support layer;

In the figures, pillow 10 comprises a support 12 which is preferably water impervious sheet material such as material used in scuba diving suits and the like. Preferably the material may be neoprene or neoprene impregnated fabric, but may be other materials such a cotton, plastic, rubberized fabric whether of cotton, polyester or other material woven or non-woven. The sheet material may also be rubber or other water impervious materials and the like. This sheet material is durable and robust and if of cotton is of heavy weight such as denim to withstand long term use in a variety of environments. Rubberized fabrics such as neoprene impregnated fabrics are commercially available.

Figure 5:
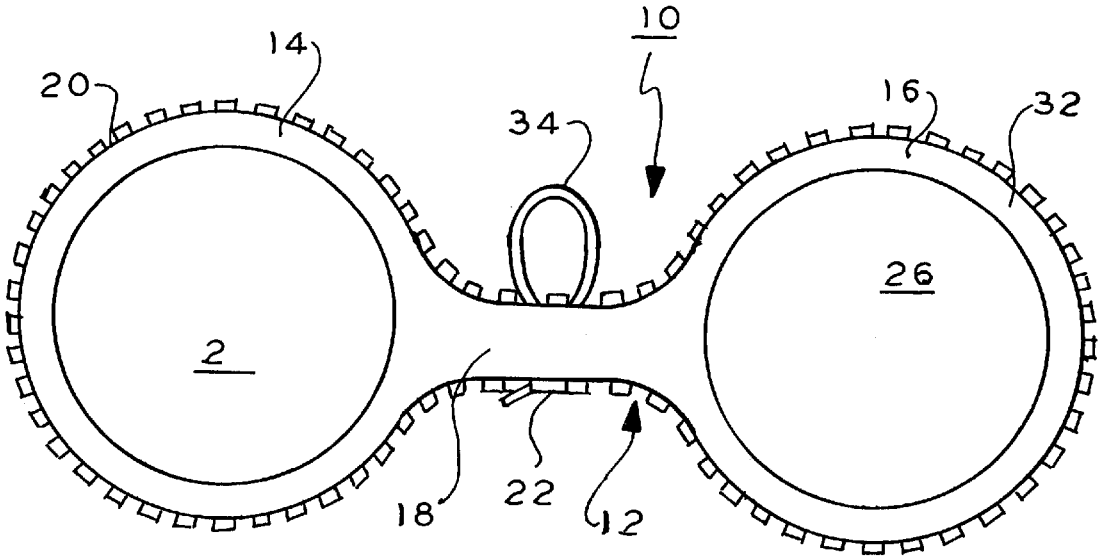
FIG. 5 is a top plan view of the pillow of the present invention in the open state.
Figure 6:
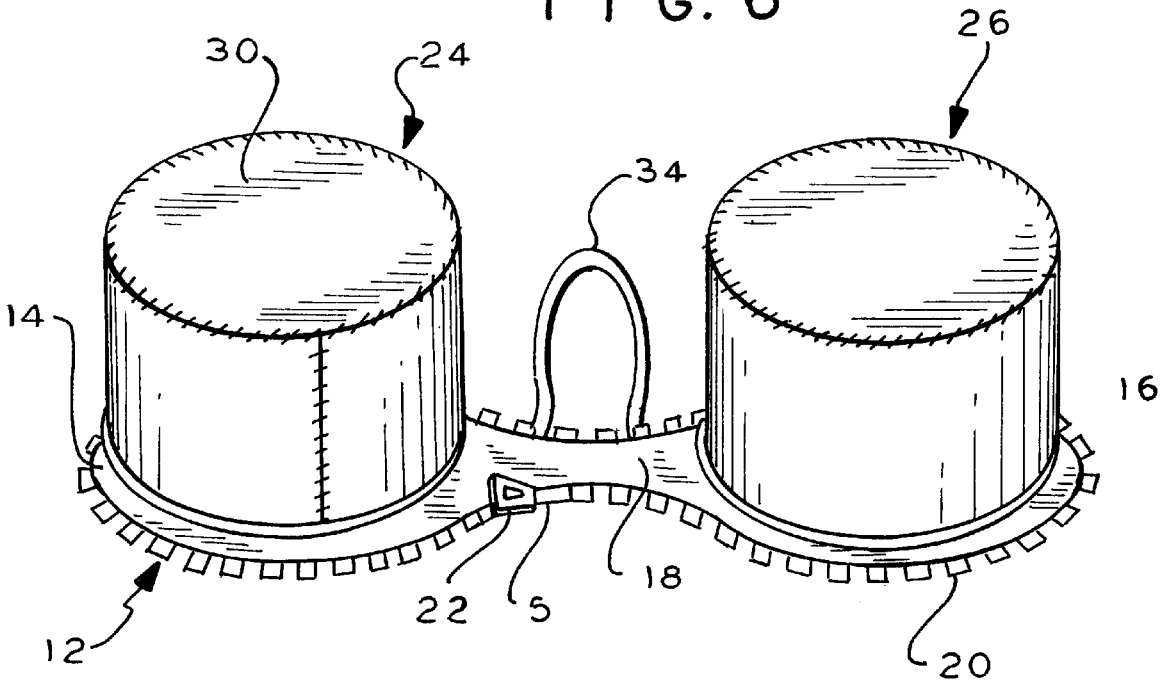
FIG. 6 is an isometric view of the pillow of FIG. 5 in the open state.

The support 12, FIG. 5, comprises two identical preferably circular sections 14 and 16 in mirror image relation. The sections 14 and 16 are connected by relatively narrower interconnection strap 18. The sections 14 and 16 may be about 4 to 6 inches in diameter but may be other sizes as well according to a given implementation. The strap 18 may be about three inches wide in the preferred embodiment. The support 12 in plan view appears hourglass in shape, FIG. 5.

A zipper 20 is attached to the peripheral edge of the support 12. The zipper 20 has a pull 22 and starts and terminates at point S. The zipper forms a water impervious seal when closed.

Secured to the support 12 are two identical pillows portions forming cushions 24, 26, FIG. 1. The description of pillow portion cushion 24 is representative. Cushion 24 comprises a foam rubber inner right circular cylindrical member 28. An outer soft flexible layer 30 encases member 28. Layer 30 is preferably cotton woven fabric, but may be any other suitable woven or non-woven material that is relatively soft to the touch and may include velour, denim, flannel, pile fabric, felt, wool, hair, leather and other materials suitable for contact by a persons face. The layer 30 is preferably sewn to the support 12 within the peripheral edge 32 region, FIG. 5, of the support 12. The layer 30 may be one piece or sewn or bonded from various sections. The layer 30 may also be bonded to the support by a suitable adhesive (not shown). The members 28 may also be attached to the support 12 by bonding in the alternative without the layer 30.

The cushions 24, 26 have a sufficient height h, FIG. 1, so as to provide good head support for a person. This height may be about 4–8 inches.

A carrying strap 34 is attached to the interconnection strap 18, FIG. 3.

Figure 4:
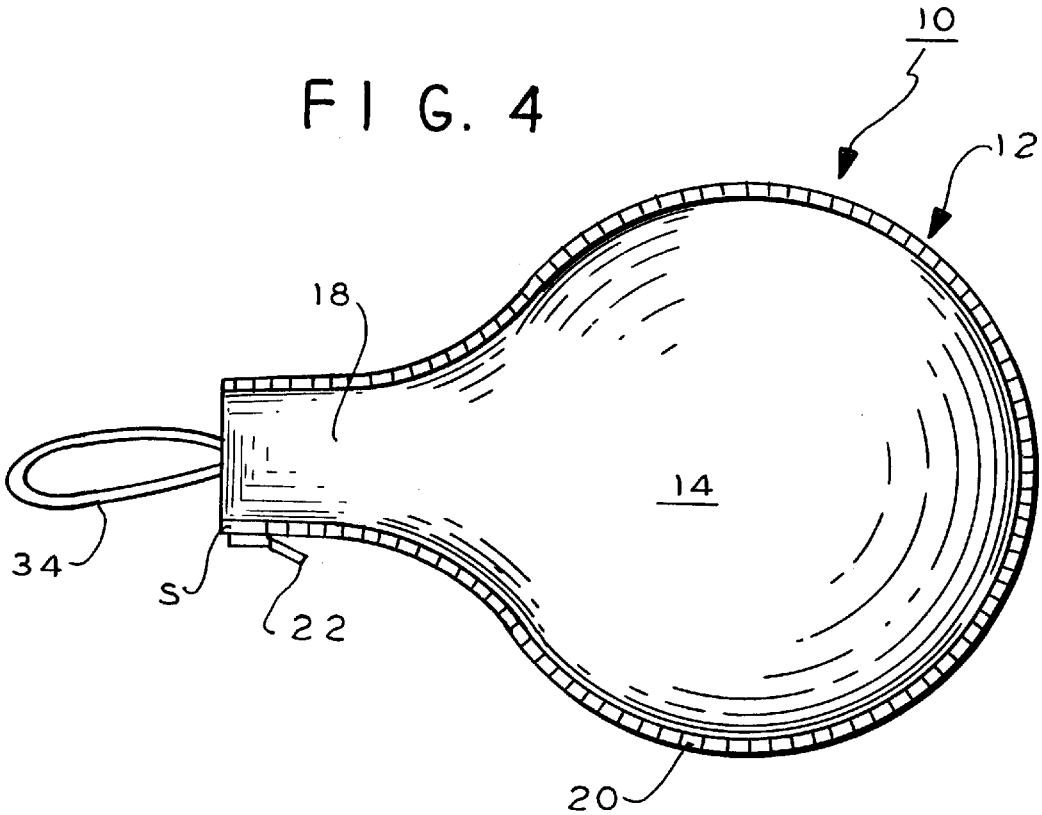
FIG. 4 is a top plan view of the pillow of the present invention in the closed state.

In the closed state, FIGS. 2 and 4, the pillow portions cushions 24 and 26 compress in the pocket formed by the overlying juxtaposed sections 14 and 16 of the support 12. The zipper 20 compresses the pillow sections when it is closed. The zipper 20 seals the entire periphery of the closed pillow 10. This forms a substantially watertight pocket for the pillow sections 24 and 26. The support 12 being made of robust and durable material permits the pillow 10 to be used in either indoor or outdoors and exhibits long life.

Figure 7:
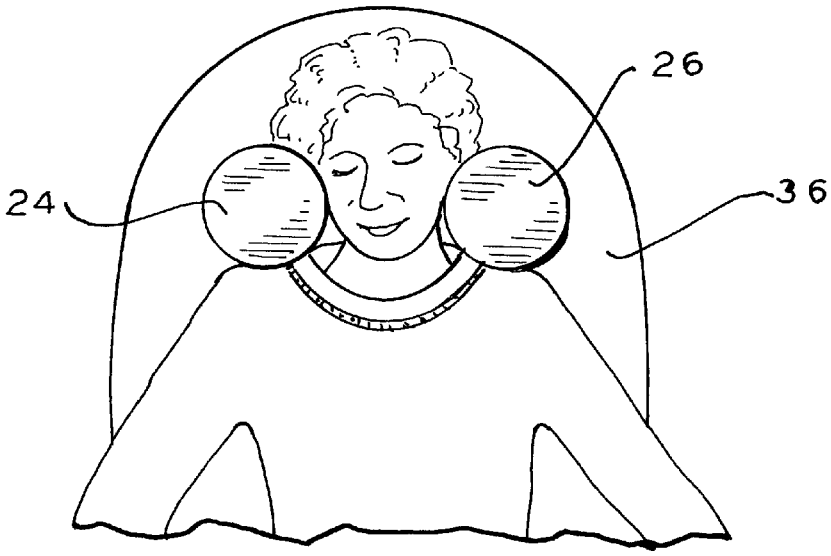
FIG. 7 is a front perspective view of a person using the pillow of FIG. 6.

In use, in FIG. 7, the pillow portion cushions 24 and 26 are positioned on either side of the head while a person is sitting in a chair 36, for example. The cushions 24, 26, being right circular cylinders, tend to hold the head upright in the sitting position and provide a comfortable support and position for the head. The cushions 24 and 26 rest on the person's shoulders and thus remain in position. The cushions provide a desirable comfort position for the head. The closed state of the pillow 10 provides a compact assembly that readily opens for use and is easily carried about.

It will occur to one of ordinary skill in this art that various modifications may be made to the disclosed embodiment without departing from the spirit and scope of the invention. The disclosed embodiment is for illustration and not limitation. The invention is defined by the appended claims.

What is claimed is:

1. A portable pillow comprising:

a sheet material support having first and second spaced bulbous sections spaced by a relatively narrower interconnection strap and having a peripheral edge;

a zipper attached to the edge and having open and closed states for forming the sections and portions of the strap into overlying juxtaposed layers in the closed state, the juxtaposed sections and portions in the closed state forming an internal pocket, the sections and strap being substantially coplanar in the open state; and a cylindrical cushion of soft, compressible material attached to each section of the support to form a pair of spaced head cushions for supporting the head of a person therebetween and arranged to be located in the pocket in the closed state of the zipper.

2. The pillow of claim 1 wherein the support is water impervious material.

3. The pillow of claim 1 wherein the cushions are circular cylindrical.

4. The pillow of claim 1 wherein the cushions are foam rubber.

5. The pillow of claim 1 wherein the support is neoprene.

6. The pillow of claim 1 wherein the support is rubberized fabric.

7. The pillow of claim 1 wherein the cushions comprise an outer fabric and a filler material, the outer fabric comprising cotton, the filler material comprising foam rubber.

8. The pillow of claim 1 wherein the cushion is attached to the support within the peripheral edge by one of stitches and bonding.

9. The pillow of claim 1 including a carrying strap attached to the interconnection strap.

10. The pillow of claim 1 wherein the sheet material and zipper are arranged so that the pocket is water impervious.

11. The pillow of claim 1 wherein the support is sheet thermoplastic material.

* * * * *